US006174144B1

(12) United States Patent
van Hamme et al.

(10) Patent No.: US 6,174,144 B1
(45) Date of Patent: Jan. 16, 2001

(54) DIAPHRAGM PISTON PUMP

(75) Inventors: Thomas van Hamme; Uwe Schade, both of Norderstedt (DE)

(73) Assignee: Bran + Luebbe GmbH, Norderstedt (DE)

( * ) Notice: Under 35 U.S.C. 154(b), the term of this patent shall be extended for 0 days.

(21) Appl. No.: 09/359,963

(22) Filed: Jul. 22, 1999

(30) Foreign Application Priority Data

Sep. 4, 1998 (DE) ..... 198 40 365

(51) Int. Cl.[7] ..... F04B 35/02
(52) U.S. Cl. ..... 417/383; 417/339; 417/395
(58) Field of Search ..... 417/383, 389, 417/273, 378, 267, 384, 339, 343, 385, 388, 395

(56) References Cited

U.S. PATENT DOCUMENTS

| | | | | |
|---|---|---|---|---|
| 3,637,330 | * | 1/1972 | Goeldner | 417/389 |
| 4,311,441 | * | 1/1982 | Scragg et al. | 417/383 |
| 4,406,595 | * | 9/1983 | Robertson et al. | 417/383 |
| 4,430,048 | * | 2/1984 | Fritsch | 417/383 |
| 4,540,346 | * | 9/1985 | Davies | 417/273 |
| 4,553,910 | * | 11/1985 | Gosschalk | 417/378 |
| 4,565,501 | * | 1/1986 | Laurendeau et al. | 417/267 |
| 4,687,424 | * | 8/1987 | Heimes | 417/384 |
| 4,806,079 | * | 2/1989 | Kuhn | 417/343 |
| 4,828,464 | * | 5/1989 | Maier et al. | 417/388 |
| 4,832,581 | * | 5/1989 | Muller et al. | 417/383 |
| 4,904,167 | * | 2/1990 | Eickmann | 417/395 |
| 5,018,949 | * | 5/1991 | Gotz | 417/339 |
| 5,332,372 | * | 7/1994 | Reynolds | 417/393 |
| 5,421,710 | * | 6/1995 | Yorita et al. | 417/385 |
| 5,720,177 | * | 2/1998 | Derrick et al. | 62/115 |
| 5,775,884 | * | 7/1998 | Westmoreland et al. | 417/383 |

FOREIGN PATENT DOCUMENTS

| | | | |
|---|---|---|---|
| 2408006 | * | 8/1975 | (DE) . |
| 3535001 | * | 4/1987 | (DE) . |
| 08159042 | * | 6/1996 | (JP) . |

* cited by examiner

*Primary Examiner*—Teresa Walberg
*Assistant Examiner*—Leonid Fastovsky
(74) *Attorney, Agent, or Firm*—Friedrich Kueffner

(57) ABSTRACT

A diaphragm piston pump with n (at least two) pump chambers each defined by a diaphragm, for mounting on a drive mechanism with n pistons, wherein the pump head with the diaphragms, the pump chambers and with covers is placed on the drive mechanism. The pump head is divided into n+1 pump head elements which are arranged next to each other in a row in such a way that the respectively second pump head element forms the cover as well as the pump chamber for the previously arranged pump head element on which it is mounted, wherein the diaphragms are braced between the pump head elements and are aligned essentially parallel to the longitudinal axis of the pistons.

8 Claims, 2 Drawing Sheets

(X)

DIAPHRAGM PISTON PUMP

BACKGROUND OF THE INVENTION

1. Field of the Invention

The present invention relates to a diaphragm piston pump with n (at least two) pump chambers each defined by a diaphragm, for mounting on a drive mechanism with n pistons, wherein the pump head with the diaphragms, the pump chambers and with covers is placed on the drive mechanism.

2. Description of the Related Art

A diaphragm piston pump of the above-described type is disclosed in DE-C2-39 03 049.

In this known diaphragm piston pump, the pump chambers, referred to as pump work chambers in the reference, are arranged on different sides of the hydraulic housing containing the cylinders for the pistons. In this diaphragm piston pump, the diaphragm is braced between the "covers" containing the pump chambers. The purpose of this configuration is to provide an inexpensive construction.

SUMMARY OF THE INVENTION

Therefore, it is the primary object of the present invention to provide a diaphragm piston pump of the above-described type which is of compact construction, makes possible a modular construction, and is inexpensive to manufacture.

In accordance with the present invention, the pump head is divided into n+1 pump head elements which are arranged next to each other in a row in such a way that the respectively second pump head element forms the cover as well as the pump chamber for the previously arranged pump head element on which it is mounted, wherein the diaphragms are braced between the pump head elements and are aligned essentially parallel to the longitudinal axis of the pistons.

Accordingly, in accordance with the present invention, the pump head, which contains the diaphragms and the pump chambers and on which are mounted the covers in the case of a conventional construction, is divided into several pump head elements. The number of pump head elements required is always one greater than the number of pistons in the drive mechanism. These pump head elements are then arranged laterally next to one another in such a way that the second pump head element forms the cover and the pump chamber for the first pump head element, etc., depending on the number of pump head elements. The first pump head element in the row of pump head elements is then only a hydraulic housing, while the subsequent pump head elements are hydraulic housings and covers with pump chambers. The last pump head element, i.e. the n+1 pump head element, then only forms a cover with pump chamber. The diaphragms are each braced between the pump head elements. The diaphragms are aligned parallel relative to the longitudinal axes of the pistons. The planes in which the diaphragms are braced and which form the connecting planes between the individual pump head elements, extend parallel to the longitudinal axes of the pistons.

The pump head elements are essentially of identical construction (only the first pump head element constitutes a hydraulic housing and the last pump head element constitutes a cover) so that pump heads of various types can be assembled in a modular manner. The construction is very compact because all pump head elements are mounted at the end face of the drive mechanism.

A very short and compact structural unit is obtained if the pistons of the diaphragm piston pump extend directly and parallel to the surface of the diaphragm into the corresponding pump head element.

However, it is also possible to arrange an intermediate separate guide housing on which the pump head elements are mounted. This makes it possible to use a drive mechanism whose cylinder spacings do not coincide with the gauges of the pump head elements.

The pump head elements can be connected to each other by various means, for example, by expanding screws. However, it is also possible to use other frictionally engaging connections, for example, means which introduce forces produced hydraulically or pneumatically.

In accordance with an advantageous feature, the pressure lines and the intake lines and the work valves can be integrated into the pump head elements. This further improves the compact construction.

However, it is also possible to integrate a homogenizing device in one of the pump head elements.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
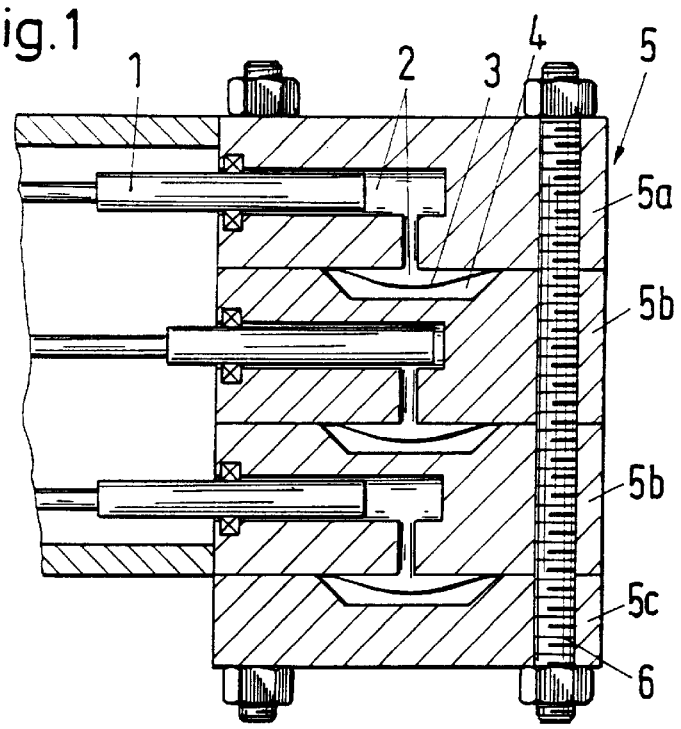
FIG. 1 is a schematic partial sectional view of an embodiment of a diaphragm piston pump according to the present invention.

The drawing shows various embodiments of the diaphragm piston pump according to the present invention in which the pump head is mounted at the front side of a drive mechanism. In the illustrated embodiment, the drive mechanism has three pistons 1. The drive mechanism is otherwise not illustrated in detail.

In the embodiment of FIG. 1, the pistons 1 constructed as plungers extend directly into the pump head 5. The work chamber 2 is filled in the conventional manner with a hydraulic medium. The individual pump chambers 4 are hydraulically connected in parallel. Each pump chamber 4 is separated from the work chamber by a diaphragm 3.

The pump head 5 is divided into a number of pump head elements 5*a*, 5*b*, 5*b*, 5*c*. It is readily apparent that the first pump head element 5*a* is only a hydraulic element. The second pump head element 5*b* forms the cover with the corresponding pump chamber for this first pump head element 5*a*. The diaphragm 3 is braced between the two pump head elements 5*a* and 5*b*. This modular principle is continued in accordance with the number of pistons up to the last pump head element 5*c* which actually only forms cover and contains a pump chamber 4 and which, together with the second to last pump head element 5*b* braces a diaphragm 3.

The above-described configuration results in a compact construction in which the diaphragms extend parallel to the longitudinal or moving direction of the pistons 1, i.e., the diaphragms extend perpendicularly of the plane against which the pump head 5 is attached. Always one pump head element more is required than the drive mechanism has pistons 1. The pump head elements 5*b* located between the first and last pump head elements are identical, so that the manufacture of the pump is more advantageous. It is even conceivable to construct all pump head elements identically and merely not to utilize certain "spaces" in the first and last pump head elements. In this last embodiment, the pump head elements 5*a* through 5*c* are braced together by means of expanding screws 6 which ensure the required frictional engagement.

Figure 2:
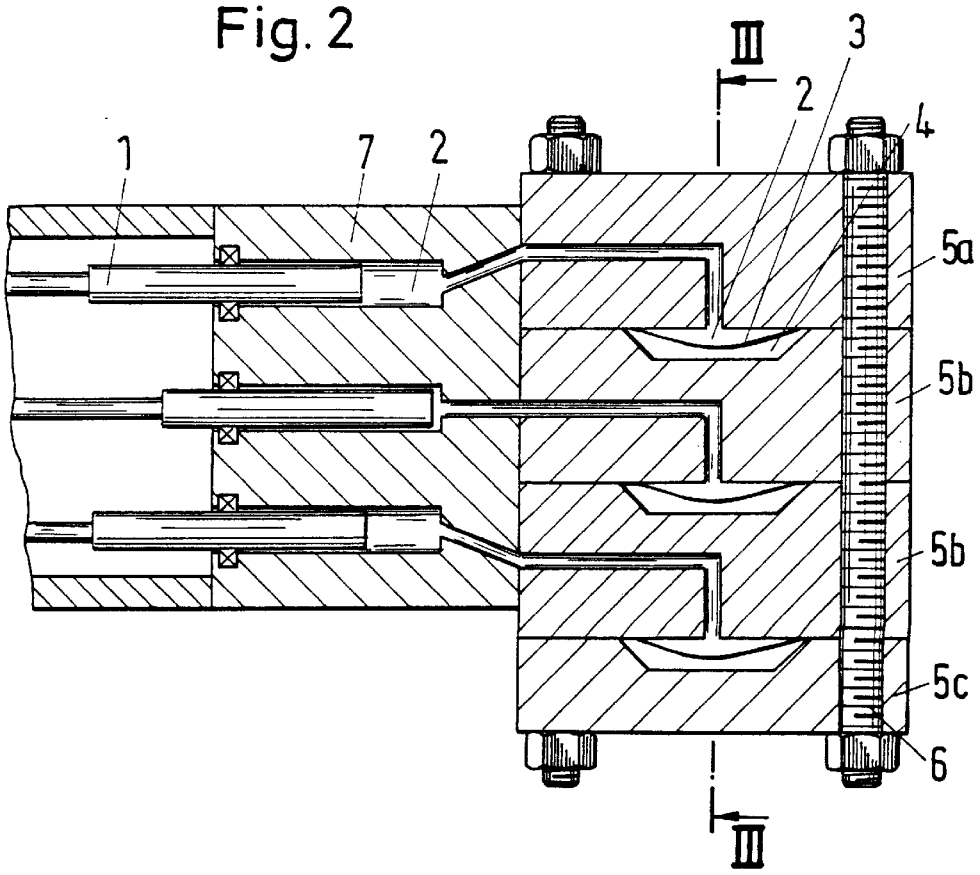
FIG. 2 is a sectional view, corresponding to FIG. 1, of another embodiment of the diaphragm piston pump.

In the embodiment of FIG. 2, the pistons 1 do not extend directly into the pump head, but a special guide housing 7 is arranged between the drive mechanism and the pump head. This makes it possible to mount the pump head on a drive mechanism whose cylinder spacings do not coincide with the gauges of the pump head elements.

When comparing the embodiments of FIGS. 1 and 2, it becomes apparent that even when the spacing between pistons is small it is still possible to construct a diaphragm pump with identical pump head elements.

Figure 3:
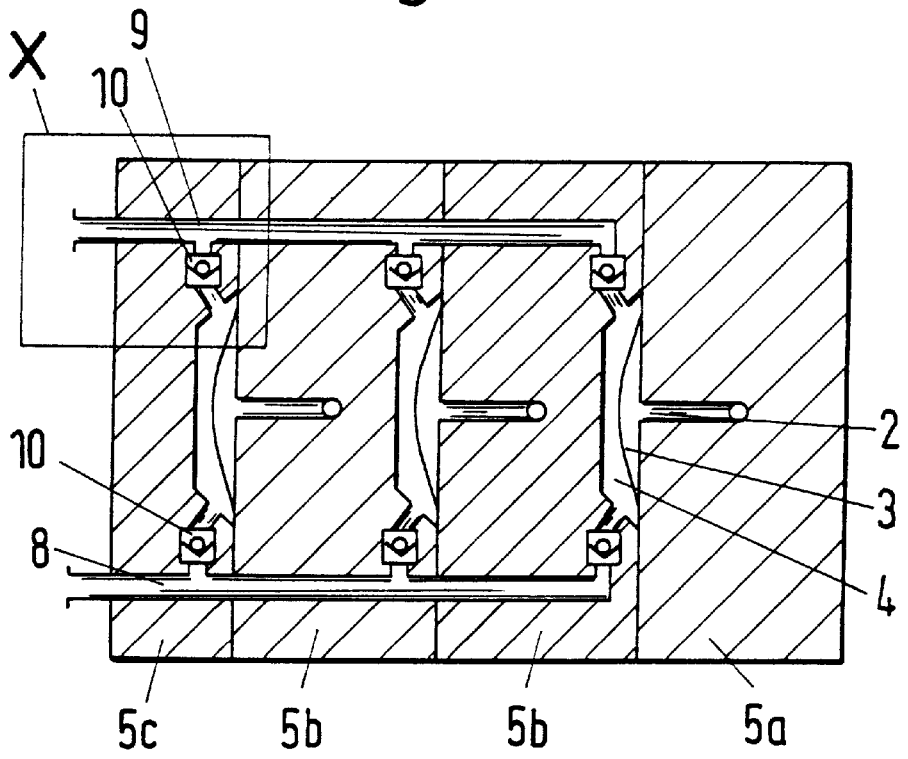
FIG. 3 is a sectional view taken along sectional line III—III of FIG. 2 showing a special embodiment with integrated pressure and intake lines and work valves.

FIG. 3 of the drawing is a sectional view along sectional line III—III of FIG. 2 and shows an embodiment in which the pressure and intake lines 9, 8 are integrated into the pump head elements in the same manner as the work valves 10. This is a particularly elegant solution. Of course, it is also possible to provide these lines and valves outside of the pump head elements and to connect them by means of appropriate connecting flanges.

Figure 4:
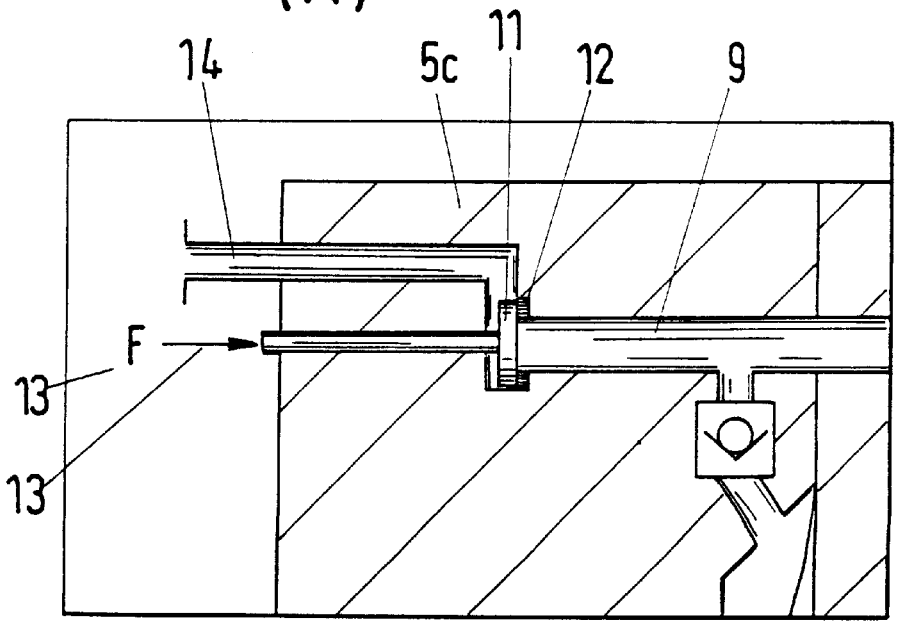
FIG. 4 shows another embodiment as a detail X of FIG. 3.

FIG. 4 of the drawing shows as a detail a homogenizing device which can be integrated in a particularly elegant manner into the last pump head element 5*c*. In the illustrated embodiment, this homogenizing device is a homogenizing valve composed of a plunger 11, a valve seat 12 and a valve actuating means 13. The actuating means introduces an axial force to the plunger, wherein this axial force can be produced mechanically, for example, by a compression spring, or hydraulically or pneumatically. It is also possible to integrate homogenizing devices of different types, for example, screens or jet dispensers.

Instead of the expanding screws 6 it is also possible to select other frictionally engaging connections for the pump head elements; for example, special frames can be used which facilitate a hydraulic or pneumatic force introduction.

While specific embodiments of the invention have been shown and described in detail to illustrate the inventive principles, it will be understood that the invention may be embodied otherwise without departing from such principles.

We claim:

1. A diaphragm piston pump having n pump chambers each defined by a diaphragm, the diaphragm piston pump being adapted to be mounted on a drive mechanism having n pistons, the diaphragm piston pump comprising a pump head comprised of n+1 pump head elements each forming a pump chamber and containing a diaphragm, wherein n is at least 2, wherein the pump head elements are mounted one behind the other in a row, such that a second pump head element in the row forms a cover and the pump chamber for a first pump head element in the row, wherein the diaphragms are braced between the pump head elements and extend essentially parallel to longitudinal axes of the pistons.

2. The diaphragm piston pump according to claim 1, wherein the pistons extend directly and parallel to a surface of the diaphragms into a corresponding pump head element.

3. The diaphragm piston pump according to claim 1, further comprising a separate guide housing for receiving the pistons, wherein the pump head elements are mounted on the separate guide housing.

4. The diaphragm piston pump according to claim 1, comprising means for connecting the pump head elements to each other, such that a required bracing force acts simultaneously on all pump head elements.

5. The diaphragm piston pump according to claim 4, wherein each pump head element has a throughbore outside of a bracing edge of the diaphragm for receiving an expanding screw.

6. The diaphragm piston pump according to claim 1, wherein pressure lines and intake lines and work valves are integrated in the pump head elements forming the pump head.

7. The diaphragm piston pump according to claim 1, wherein a homogenizing device is integrated in the last pump head element.

8. The diaphragm piston pump according to claim 7, wherein the homogenizing device is comprised of a homogenizing valve with a plunger and a valve seat and means for actuating the valve.

* * * * *